US009112303B2

(12) United States Patent
Zeliff et al.

(10) Patent No.: US 9,112,303 B2
(45) Date of Patent: Aug. 18, 2015

(54) MAGNETIC CONNECTOR

(71) Applicant: Adonit CO. LTD., Taipei (TW)

(72) Inventors: Zachary Joseph Zeliff, Taipei (TW); Yueh Hua Li, Taipei (TW); Kristopher Perpich, Austin, TX (US); Yu Tzu Huang, Taipei (TW); Kai Yi Lu, Taipei (TW)

(73) Assignee: ADONIT CO., LTD., Taipei (TW)

( * ) Notice: Subject to any disclaimer, the term of this patent is extended or adjusted under 35 U.S.C. 154(b) by 170 days.

(21) Appl. No.: 13/905,106

(22) Filed: May 29, 2013

(65) Prior Publication Data

US 2013/0323941 A1 Dec. 5, 2013

Related U.S. Application Data

(60) Provisional application No. 61/655,267, filed on Jun. 4, 2012.

(51) Int. Cl.

| | |
|---|---|
| ***H01R 11/30*** | (2006.01) |
| ***H01R 13/62*** | (2006.01) |
| *H01R 13/24* | (2006.01) |

(52) U.S. Cl.

CPC ..... *H01R 13/6205* (2013.01); *H01R 11/30* (2013.01); *H01R 13/2478* (2013.01)

(58) Field of Classification Search

CPC . H01R 13/6205; H01R 11/30; H01R 13/2478
USPC ..... 439/38–40, 700
See application file for complete search history.

(56) References Cited

U.S. PATENT DOCUMENTS

| | | | |
|---|---|---|---|
| 3,521,216 | A | 7/1970 | Tolegian |
| 3,808,577 | A | 4/1974 | Mathauser |
| 3,810,258 | A | 5/1974 | Mathauser |
| 4,025,964 | A | 5/1977 | Owens |
| 4,112,941 | A | 9/1978 | Larimore |
| 4,211,456 | A | 7/1980 | Sears |
| 4,317,969 | A | 3/1982 | Riegler et al. |
| 4,874,316 | A | 10/1989 | Kamon et al. |
| 5,004,425 | A | 4/1991 | Hee |
| 5,401,173 | A | 3/1995 | Grandchamp et al. |
| 5,921,783 | A | 7/1999 | Fritsch et al. |
| 6,565,363 | B2 | 5/2003 | Downing |
| 7,264,479 | B1 | 9/2007 | Lee |
| 7,331,793 | B2 | 2/2008 | Hernandez et al. |
| 7,467,948 | B2 | 12/2008 | Lindberg et al. |

(Continued)

FOREIGN PATENT DOCUMENTS

| | | | |
|---|---|---|---|
| CN | 200997477 | Y | 12/2007 |
| CN | 101118999 | A | 2/2008 |

*Primary Examiner* — Khiem Nguyen

(74) *Attorney, Agent, or Firm* — Novak Druce Connolly Bove + Quigg LLP

(57) ABSTRACT

Embodiments of magnetic connectors are disclosed. Embodiments show the use of magnetic connectors for power and/or signal bus coupling to electronic devices from support bases, stands, or cables. In some embodiments, spherical contacts, such as ball bearings, are pressed into firm contact with an electronic device by the use of conductive springs, which in turn electrically couple the spherical contacts to the bus lines. Contact arrangements are shown which allow rotation of the electronic device against an embodiment of magnetic connector. Arrangements of multiple magnets having differing polarities are shown when alignment of an electronic device in a particular orientation is required.

12 Claims, 22 Drawing Sheets

(56) References Cited

U.S. PATENT DOCUMENTS

| | | | |
|---|---|---|---|
| 7,517,222 | B2 | 4/2009 | Rohrbach et al. |
| 7,637,746 | B2 | 12/2009 | Lindberg et al. |
| 7,645,143 | B2 | 1/2010 | Rohrbach et al. |
| 7,658,613 | B1 | 2/2010 | Griffin et al. |
| 7,841,776 | B2 | 11/2010 | DiFonzo et al. |
| 8,087,939 | B2 | 1/2012 | Rohrbach et al. |
| 2007/0161262 | A1 | 7/2007 | Lloyd |
| 2007/0254510 | A1 | 11/2007 | DeBey |
| 2007/0259536 | A1 | 11/2007 | Long et al. |

MAGNETIC CONNECTOR

BACKGROUND

1. Field of the Disclosure

The disclosure relates to computer accessories, and more specifically, to a connector transmitting electrical signals and/or electrical power.

2. Description of the Related Art

With recent innovations, portable computing devices are experiencing a dramatic surge in popularity.

The portability of the devices allows for deployment for use in a variety of external settings, such that peripheral devices may often be connected in environments unsuited to such installations. As a result, connections for such devices are more susceptible than usual to inadvertent disconnection, which may often be accompanied by excessive force, such as when a connecting cable is kicked or tripped on, or snags on an object. Since most conventional connection systems employ some form of mechanical fixing means to maintain the integrity of the connection, such as pins, releases, or flexible members, such accidental disconnection presents a distinct threat of severe damage to the connection system, interrupting service and incurring replacement/repair costs.

In response to these conditions, the use of magnetic members to secure a connection has become popular, wherein embedded magnetic members provide more than sufficient attraction to assure robust connection, but easily disengage when forcibly separated.

One solution comprises a polygonal connector received in a correspondingly shaped jack. A plurality of magnetic members in the jack attract and fix corresponding ferromagnetic members in the jack, thereby securing the connection for transmission of signals therethrough. This solution, however, involves a complex and costly connection for maintaining actual signal transmission.

Alternatively, in U.S. Patent Application Publication No. 2007/0254510 A1, DeBey discloses a signal carrying plug and a signal carrying receptacle forming a magnetic signal carrying connector, wherein electrical terminals of the source and electrical contacts of the load are held against one another by at least one magnet affixed adjacent (to) the source terminals, wherein the at least one magnet is disposed within a recess to protect against projection of unwanted magnetic fields and to mate with a complementary structure to provide positive alignment and registration of the terminals and contacts. The force of the magnet is sufficient to hold the load contacts in place for operation but insufficient to provoke damage to the connector plug or attached receptacle and any attached structures, such as cabling, if the connector is pulled apart. While the solution cited simplifies the structural requirement for connection, limitations remain.

In both citations, limitations may include, first, the requirement for the connectors to be precisely aligned in order to establish a connection, negatively affecting efficiency of setup and reducing ease of use, especially in spatially challenging environments.

Further, the connection systems may provide no or low tolerance for cables thereof to twist radially, with corresponding rotation of the connection assembly, which either remains immovable or interrupts connectivity, such that impeded operations and real device damage are likely.

Moreover, existing connection systems are designed to create cable connections, and do not provide a support base or stable platform for the electronic devices so connected.

DETAILED DESCRIPTION OF THE DISCLOSURE

An electrical connector as disclosed may comprise at least a receiving side and a received side. In some embodiments, the receiving side may be deployed in a host, such as, for example, a panel or other PC, or in a dongle or other structure connecting to the host, and the received side may be deployed as part of a peripheral device or terminating a cable attached thereto. While descriptive details of the disclosure as follows are predicated on such an arrangement, alternative configurations, such as the received side deployed in the host and the receiving side on the peripheral device or cable attaching thereto, may be equally applicable and remain well within the scope of the disclosure.

Figures 1A, 1B, 1C:
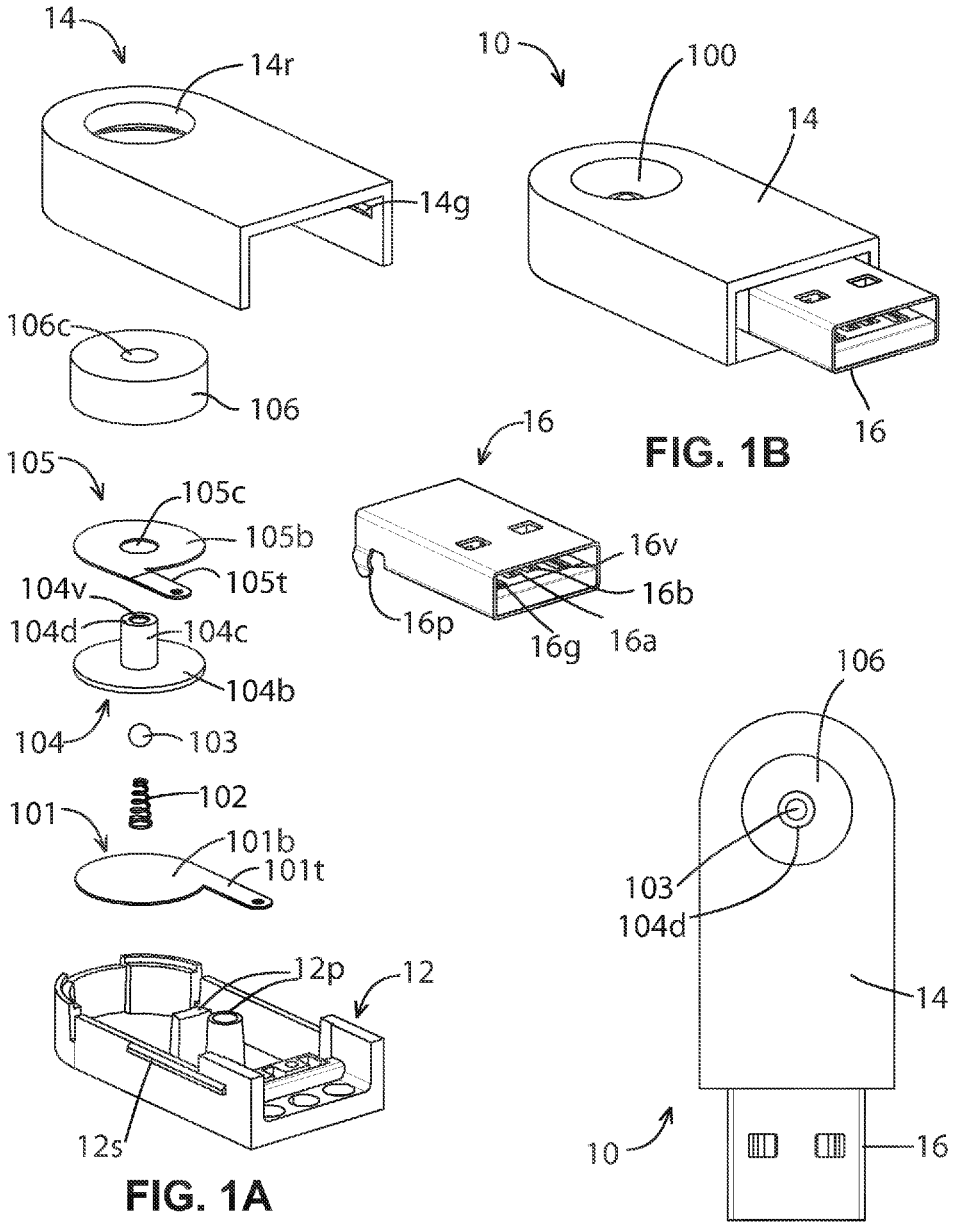
FIG. 1A is an exploded diagram of a receiving side of an embodiment of an electrical connector.
FIG. 1B is a perspective view of a dongle comprising an embodiment of a receiving side of an electrical connector.
FIG. 1C is a top view of a dongle comprising an embodiment of a receiving side of an electrical connector.

FIG. 1A is an exploded diagram of a receiving side 100 of an embodiment of an electrical connector as disclosed, the receiving side 100 comprising a second terminal 101 having a body 101*b* and a trace 101*t*, a resilient member 102 seated thereon, and a contact member 103 seated at the end of the resilient member 102, all of conductive material. In this embodiment, the resilient member is a compression spring, which for example but without limitation may be conical or cylindrical, and the contact member 103 may be a spherical conductive solid or hollow form, for example a ball bearing, or a prolate spheroidal pin. The receiving side of an embodiment of an electrical connector as disclosed further comprises a columnar base 104, of electrically insulative non-conducting material. The columnar base 104 as shown comprises a base 104*b* corresponding in size and shape to the body 101*b* of the second terminal 101, and a hollow column 104*c* perpendicular to the base, the hollow column 104*c* having an inner void 104*v* that accommodates the resilient member 102 and the contact member 103 seated at the end thereof. The inner void 104*v* of the hollow column 104*c* may optionally narrow at the distal end 104*d* (the end distal to the base 104*b*) to retain the contact member 103. The receiving side of an embodiment of an electrical connector as disclosed further comprises an annular first terminal 105 having a trace 105*t* and a body 105*b* through the center 105*c* of which the hollow column 104*c* of the columnar base 104 passes, and an annular magnetic member 106, of conductive material, seated on the body 105*b* of the first terminal 105, through the center 106*c* of which the hollow column 104*c* of the columnar base 104 also passes.

FIG. 1B and FIG. 1C show an assembled dongle 10. FIG. 1D shows a standard USB connector of a type that may be assembled into the dongle. The dongle 10 comprises a lower housing 12, an upper housing 14, a standard USB connector 16, and receiving side 100. The standard USB connector 16 comprises prongs 16*p* (second prong on opposite side not visible due to perspective) that mate to receptacles in the lower housing 12, thereby securing the standard USB connector 16 to the lower housing 12. The standard USB connector 16 further comprises power lead 16*v* and ground lead 16*g*, as well as two data leads 16*a*, 16*b*. The traces 101*t*,105*t* are electrically coupled to power lead 16*v* and ground lead 16*g*, either with trace 101*t* coupled to power lead 16*v* and trace 105*t* coupled to ground lead 16*g* or with trace 101*t* coupled to ground lead 16*g* and trace 105*t* coupled to power lead 16*v*. The lower housing 12 has a plurality of engaging lugs 12*s* that lock into undercuts 14*g* in the upper housing 14 when assembled. The lower housing also has various protrusions 12*p* that help to position and secure the various parts of the receiving side 100 in place. The upper housing 14 further has a through hole 14*r* which when assembled defines an alignment cavity, for example without limitation a right cylindrical cavity or circular conic frustum, into which a received end (not shown) may enter, thereby being aligned against the conductive elements 103,106 of the receiving side.

The contact 103 is spherical and conductive, and may for example be a ball bearing made of a metal such as copper, brass, or stainless steel. The use of such a ball bearing provides for simplified low-cost construction and ready parts availability when compared to the prior art, which use specially made pins with multiple diameters and shaped contact tips so that they are constrained within a constricted tube.

Figure 22:
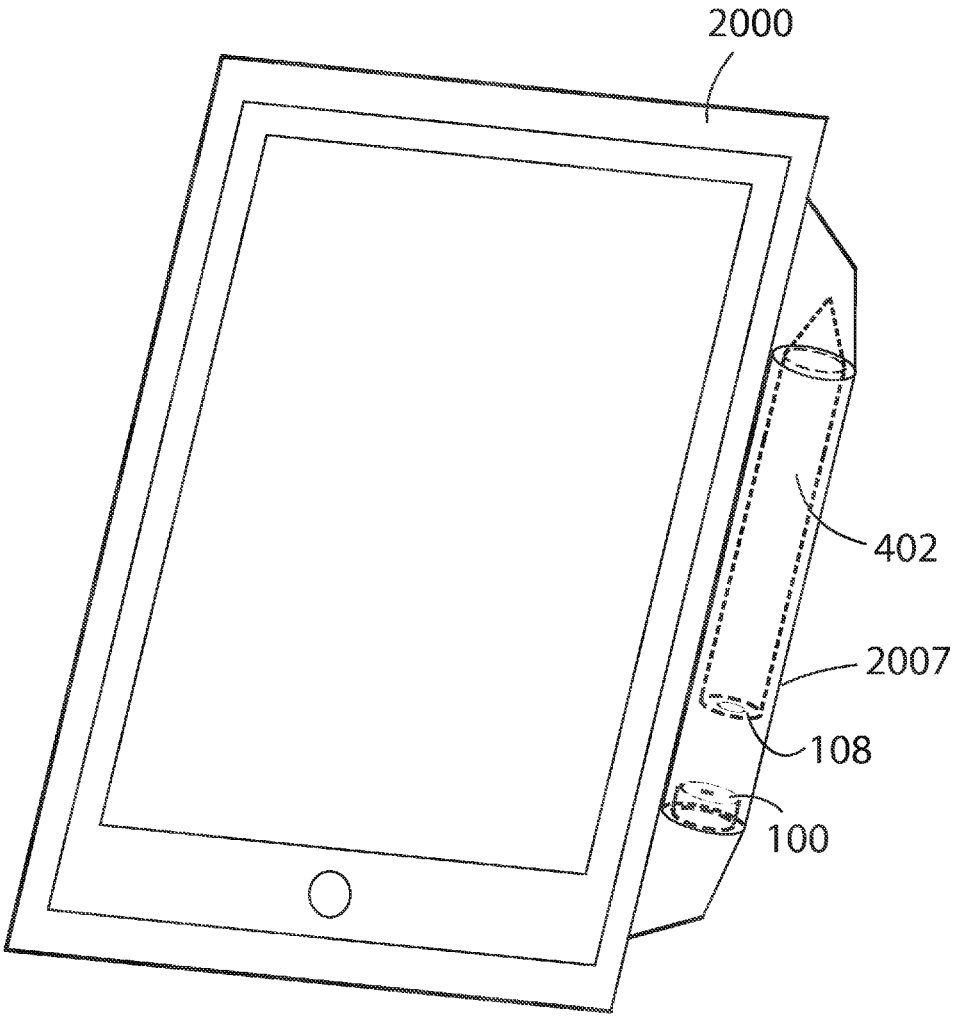
FIG. 22 is an illustrative view of the received side and the receiving side of the electrical connector as may be implemented with a tablet PC and a stylus.

In use, the dongle 10 of FIG. 1B is plugged into a USB socket such as are commonly in use on laptop computers, tablet computers, and wall socket chargers. The dongle 10 has sufficient magnetic strength to hold an electronic device, such as a stylus as shown in FIG. 22 below, or such as the ADONIT JOT TOUCH line of electronic pressure-sensitive styluses, at any orientation with respect to gravity. The dongle 10 thus provides a stable platform on which an electronic device may rest while charging.

In one embodiment, the receiving side of an embodiment of the electrical connector as disclosed is fixed and maintained within a casing having an alignment cavity, encircling the assembly and open at the end distal from the second terminal 101, the casing omitted from the FIG. 1 view for clarity. Further, in such embodiments, the second terminal 101 and first terminal 105 are respectively electrically coupled to a specific destination component of the host, such as, for example, a power supply or signal bus, so that the electrical connector may pass either DC power, AC power, or electrical signals, or a combination thereof, simultaneously or multiplexed, between the host and an electronic device. Electrical signals may be digital or analog, or may vary as appropriate.

Figure 2:
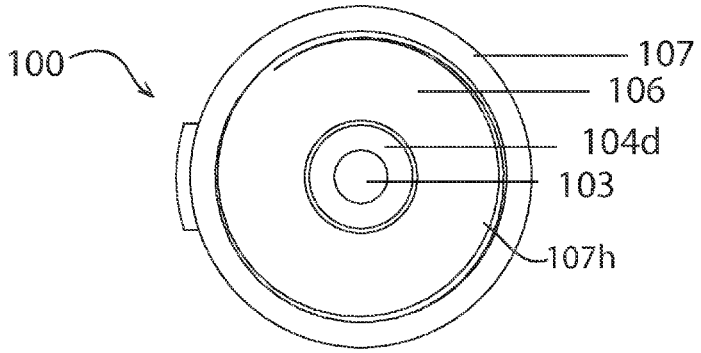
FIG. 2 is an end view of a receiving side of an embodiment of the electrical connector.

FIG. 2 is an end view of a receiving side 100 of an embodiment of the electrical connector as disclosed, showing a contact member 103, a distal end 104*d* of the columnar base 104, an annular magnetic member 106, and a housing 107 with a receiving cavity 107*h* in the form of a through hole. The receiving cavity 107*h* may for example be circular in cross section, and may have a diameter smaller than the outer diameter of the annular magnetic member 106, thereby serving to retain the annular magnetic member 106 (and other parts stacked behind it) within the assembled electrical connector. Alternately, the annular magnetic member 106 and other parts stacked behind it may be retained by other means such as adhesives.

Figure 3:
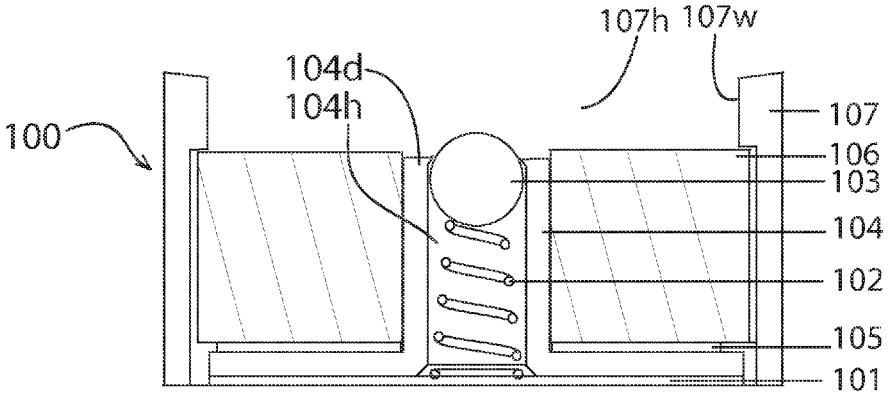
FIG. 3 is a cross section of a receiving side of an embodiment of the electrical connector.

FIG. 3 is a cross section of a receiving side 100 of an embodiment of the electrical connector as disclosed, showing a second terminal 101, a resilient member 102 seated thereon, a contact member 103 seated at the end of the resilient member 102, a columnar base 104, an annular first terminal 105, an annular magnetic member 106, and a housing 107 having a receiving cavity 107*h* formed by housing walls 107*w* to align a received end (not shown) in the receiving side 100. As shown, in this embodiment, the contact member 103 protrudes partially beyond the level of the surface of the annular magnetic member 106. The inner hollow 104*h* of the columnar base 104 narrows near the distal end 104*d* so that the contact member 103 is captured by the columnar base.

Figure 4:
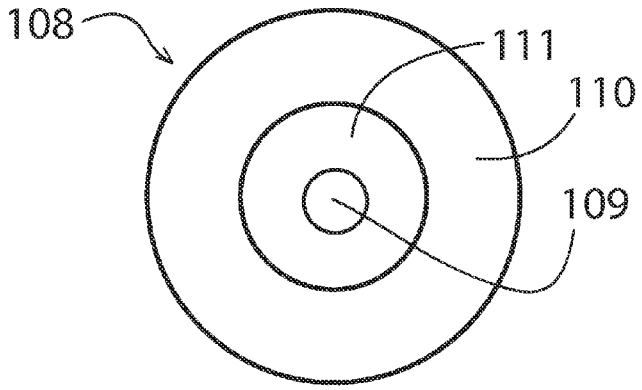
FIG. 4 is an end view of a received side of an embodiment of the electrical connector.

FIG. 4 is an end view of a received side 108 of an embodiment of the electrical connector as disclosed, showing a contact pin 109 centered within and insulated from a sleeve 110 by an insulation layer 111. The contact pin 109 is made of conductive material, which may optionally also be ferromagnetically attractive, and the sleeve 110 is made of conductive and ferromagnetically attractive material. The insulation layer 111 is of a non-conductive material. In an alternate embodiment, the insulation layer 111 may be air. In that case, air is used to insulate the contact pin 109 from the sleeve 110.

Figure 5A:
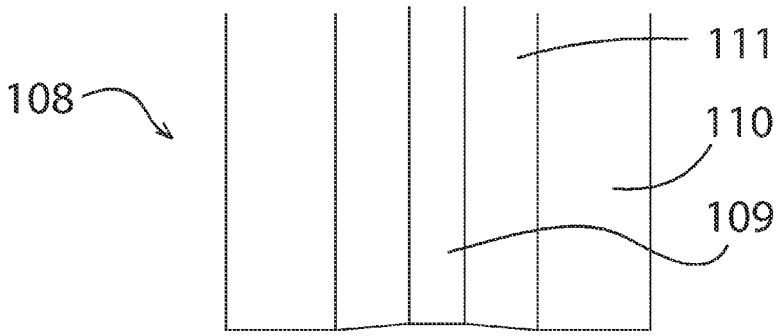
FIG. 5A is a cross section of a received side of an embodiment of the electrical connector.
Figure 5B:
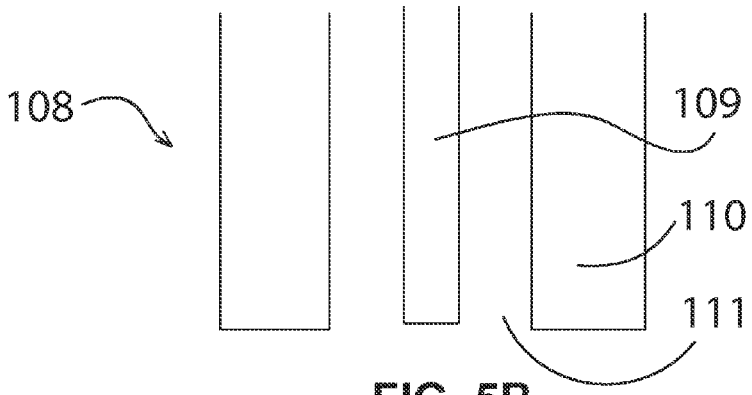
FIG. 5B is a cross section of a received side of an embodiment of the electrical connector.

FIG. 5A is a cross section of a received side 108 of an embodiment of the electrical connector as disclosed, showing a contact pin 109 centered within and insulated from a sleeve 110 by the insulation layer 111. As illustrated in FIG. 5B, an alternate embodiment, air forms the insulation layer 111 that is used to insulate the contact pin 109 from the sleeve 110.

Figure 6:
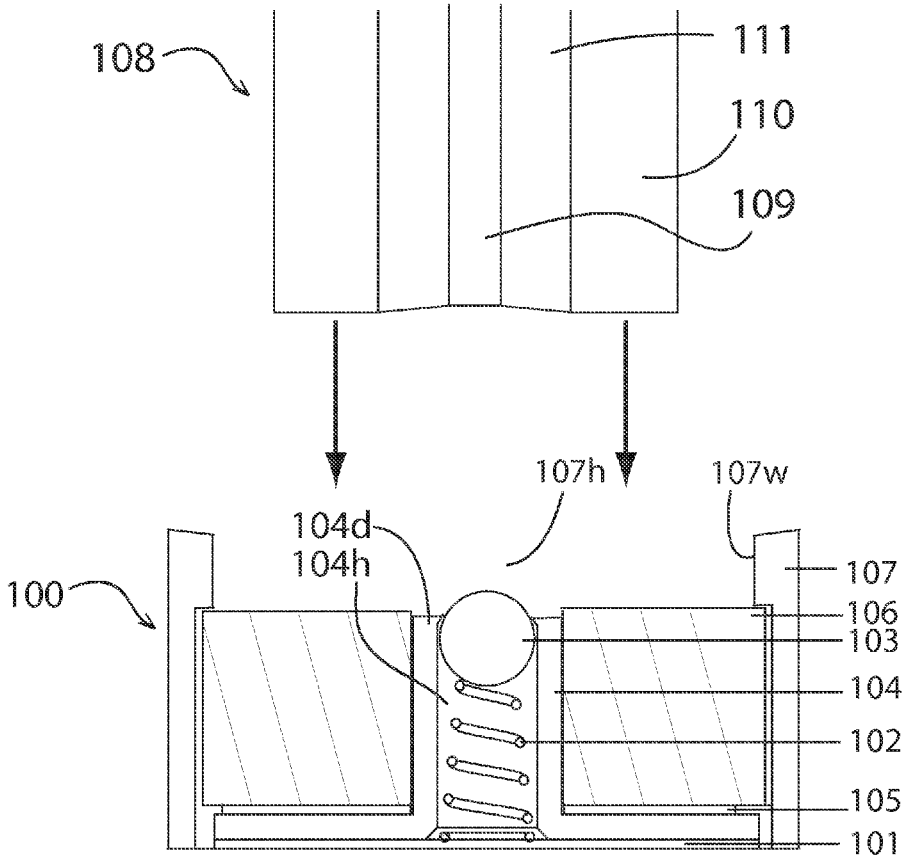
FIG. 6 is a cross section of a received side and a receiving side of an embodiment of the electrical connector.

FIG. 6 is a cross section of a received side 108 and a receiving side 100 of an embodiment of the electrical connector as disclosed, illustrating exemplary operation of the electrical connector. As shown, when the received side 108 is moved in the direction indicated by the arrows and thereby received in the receiving side 100, the contact pin 109 contacts the contact member 103 and exerts sufficient force to compress the resilient member 102, establishing an effective electrical coupling from the contact pin 109 to the second terminal 101 such that the contact pin 109 is electrically coupled and thus in signal communication with the second terminal 101. The proximal end of the sleeve 110 is magnetically attracted to the magnetic member 106, and so likewise abuts and makes contact with the face of the annular magnetic member 106, establishing effective electrical coupling by the sleeve 110 through the annular magnetic member 106 to the first terminal 105. At such time, the entire received end 108 is snugly and securely retained in effective contact with the receiving side 100 via magnetic force. The casing 107 forms the sides of a cavity 1071, with the annular magnetic member 106 forming a bottom of the cavity, with the cavity 1071 aligning the outside surface 1101 of the sleeve 110 such that the various conductive components of the receiving side 100 and received end 108 are appropriately aligned and thus electrically coupled.

Figure 7:
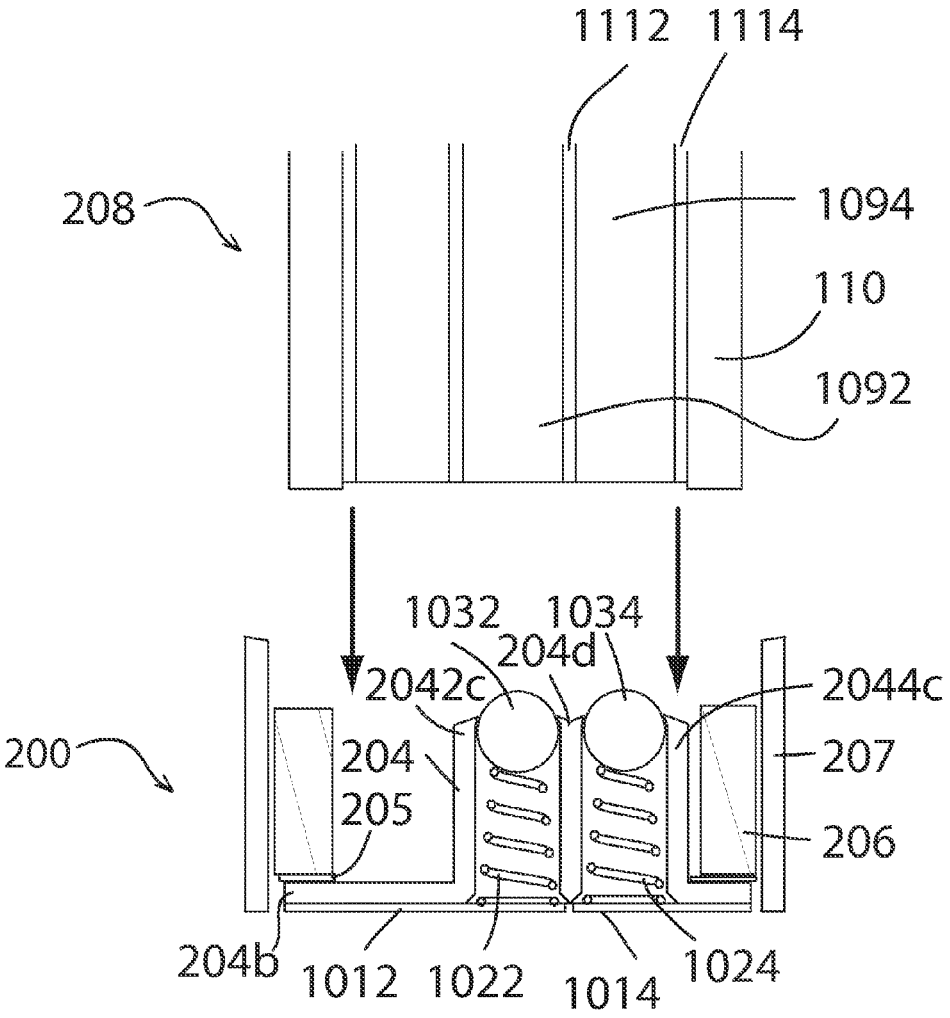
FIG. 7 is a cross section of a received side and a receiving side of an embodiment of the electrical connector.

FIG. 7 is a cross section of a received side 208 and a receiving side 200 of an embodiment of the electrical connector as disclosed. In this embodiment, the received side 208 has multiple contact components. For example, as illustrated in FIG. 7, in addition to the contact pin 1092, the received side 208 comprises a contact cylinder 1094. That is, the received side has two contact components. The contact cylinder here comprises a cavity or aperture in the center for receiving the contact pin 1092. The contact pin 1092 and the contact cylinder 1094 are surrounded by the sleeve 110. The contact pin 1092, the contact cylinder 1094 and the sleeve 110 are insulated from one another by insulation layers 1112 and 1114, or by air gaps (not shown) between the contact pin 1092, contact cylinder 1094, and sleeve 110.

Correspondingly, the receiving side 200 comprises multiple contact members and multiple resilient members to match the multiple contact components of the received side 208. In this example, the receiving side 200 comprises two contact members 1032 and 1034, and two resilient members 1022 and 1024 to match the contact pin 1092 and contact cylinder 1094 of the received side 208. Accordingly, the columnar base 204 is modified to include two hollow columns 2042*c*, 2044*c*, and the annular magnetic member 206 may also differ by having a larger inside diameter to accommodate the modified columnar base 204 that comprises the two contact members 1032 and 1034 and the two resilient members 1022 and 1024 and the two hollow columns 2042*c*, 2044*c*. The first terminal 205 is also modified to reflect the size change of the annular magnetic member 106. Lastly, instead of a second terminal 101, there are now second terminal 1012 and third terminal 1014, as illustrated in FIG. 7.

Accordingly, when the received end 208 is moved in the direction indicated by the arrows in FIG. 7, and thereby received in the receiving side 200, the contact pin 1092 contacts the contact member 1032, the contact cylinder 1094 contacts the contact member 1034, thereby exert sufficient force to compress the resilient members 1022 and 1024, respectively, establishing effective electrical connection therethrough to the second terminal 1012 and third terminal 1014. Simultaneously, the end of the sleeve 110 abuts and makes contact with the face of the annular magnetic member 106, establishing effective electrical connection therethrough to the first terminal 105. At such time, the entire received end 208 is snugly and securely retained in effective contact with the receiving side 200 via magnetic force.

The difference between the embodiments in FIGS. 1-6 and FIG. 7 is the number of electrical connections established between the receiving side 100 or 200 and the received end 108 or 208. In the embodiment of FIGS. 1-6, two electrical connections are established: one between the contact pin 109 and the second terminal 101 (electrically coupled through the contact member 103 and the resilient member 102,) and another between the sleeve 110 and the first terminal 105 (electrically coupled through the annular magnetic member 106.) On the other hand, in the embodiment in FIG. 7, three electrical connections are established between the contact pin 1092 and one of the second terminal 1012 (via the contact member 1032 and the resilient member 1022,) and between the contact cylinder 1094 and third terminal 1014 (via the contact member 1034 and the resilient member 1024,) and between the sleeve 110 and the first terminal 105 (via the annular magnetic member 106.) The additional electrical connection allows the present disclosure to transmit additional signals and/or supply power through additional paths, possibly at different voltages. It is to be noted that the number of electrical connections may be increased by modifying the structures of the receiving side 200 and the received side 208 according to this embodiment, in ways obvious to persons having ordinary skill in the art. In addition, this embodiment enables the rotation of the received side 208 within the receiving side 200 to be accommodated with no undue strain or damage inflicted on cabling attached thereto.

Figure 8:
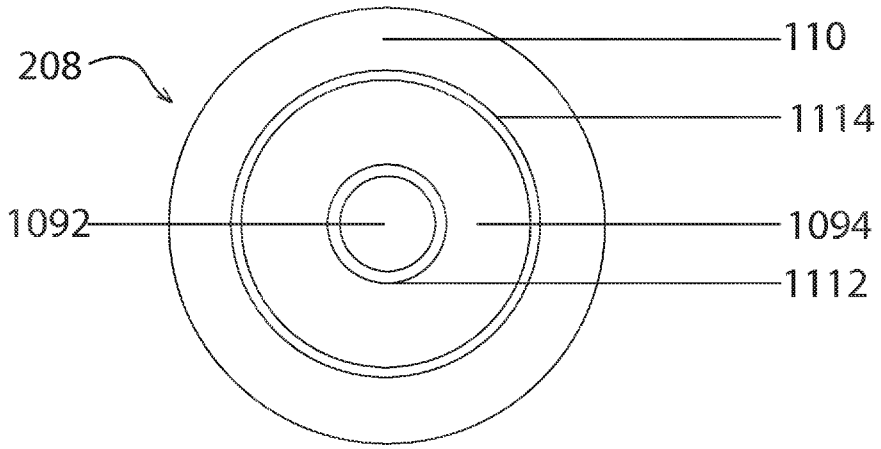
FIG. 8 shows an end view of a received side of an embodiment of the electrical connector.

FIG. 8 shows an end view of a received side 208 of an embodiment of the electrical connector as disclosed in FIG. 7, showing a contact pin 1092 centered within the sleeve 110 and insulated from the contact cylinder 1094 by an insulation layer 1112. In addition, the contact cylinder is insulated from the sleeve 110 by an insulation layer 1114. One or both of the insulation layers 1112, 1114 may be an air gap, or they may be of a nonconductive solid, for example (without limitation) a polymer.

Figure 9:
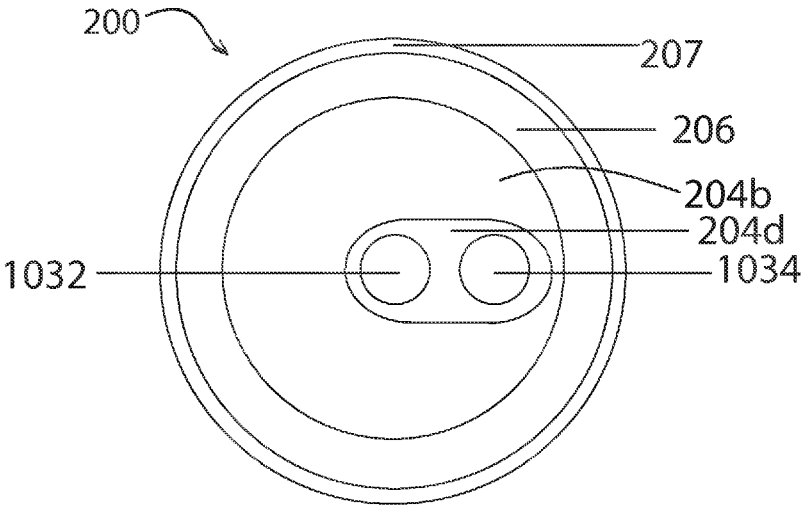
FIG. 9 is a an end view of a receiving side of an embodiment of the electrical connector.

FIG. 9 is a an end view of a receiving side 200 of an embodiment of the electrical connector as disclosed in FIG. 7, showing contact members 1032 and 1034, a columnar base 204 having two columns and a distal end 204*d*, an annular magnetic member 206, and a casing 207. It is to be noted that the volume between the columnar base 204 and the annular magnetic may be a cavity, as illustrated in FIG. 7, wherein base 204*b* is visible. Alternately, the columnar base 204 may be designed to fill that void entirely, providing support and alignment to the annular magnetic member 206, and preventing the accumulation of debris in a cavity as sometimes occurs in real-world use conditions.

In the following embodiments illustrated in FIGS. 10- 12 and 14, the elements of the received side 108, i.e., the contact pin 109, the sleeve 110 and the insulation layer 111, are identical to those in the embodiment illustrated in FIG. 6, and thus the characteristics will not be repeated.

Figure 10:
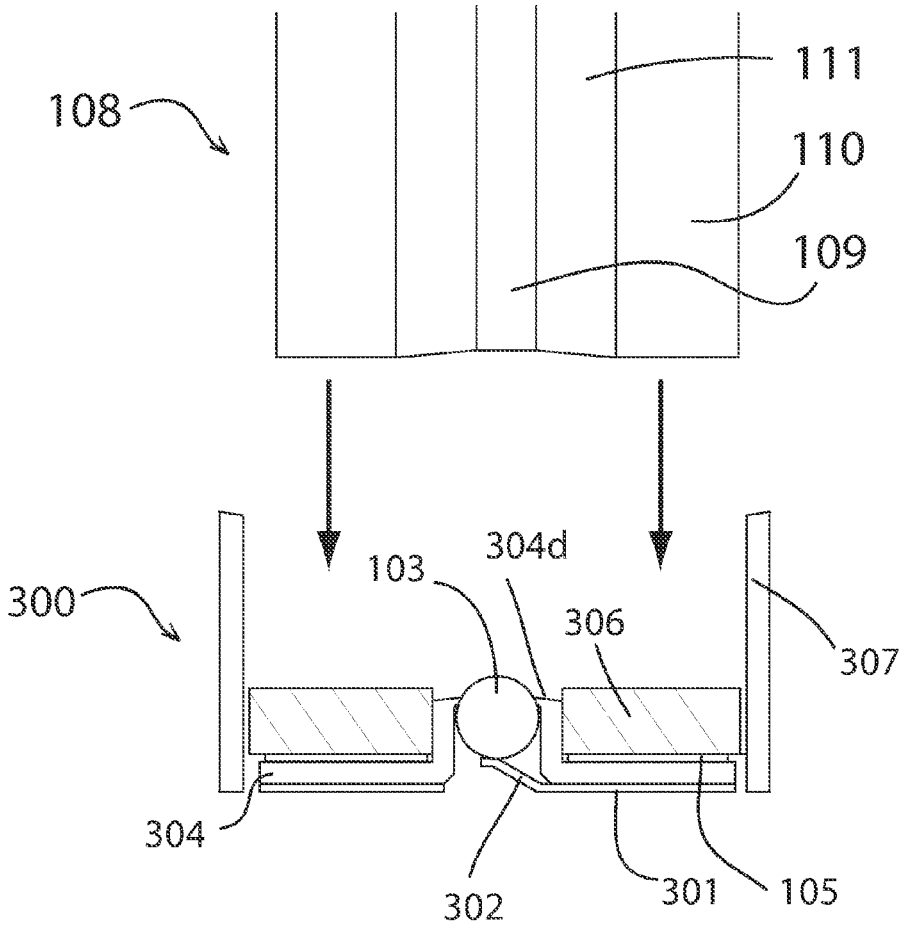
FIG. 10 is a cross section of a received side and a receiving side of an embodiment of the electrical connector.

FIG. 10 is a cross section of a received side 108 and a receiving side 300 of an embodiment of the electrical connector as disclosed. At the receiving side 300 of the present embodiment, instead of having a resilient member 102 provide biasing and electrical coupling to the contact member 103, the second terminal 301 is modified to have a tip 302 protruding toward the distal surface 304*d* of the columnar base 304, and supporting the contact member 103, as illustrated in FIG. 10. The protruding tip thus inter alia performs the function of a sheet metal spring. In this embodiment, when the received side 108 is moved in the direction indicated by the arrows and thereby received in the receiving side 300, the contact pin 109 makes contact with the contact member 103, which contacts the first protruding tip of the second terminal 301. Therefore, an effective electrical connection is established between the contact pin 109 and the second terminal 301. The second electrical path, of first terminal 105 electrically coupling to magnetic member 306, which attracts sleeve 110 and conducts to sleeve 110, is as described in previous embodiments. Casing 307 serves to align the incoming received side 108 and to support and contain the various components of the receiving side 300. The casing may be straight-walled as shown, or may have a retaining wall as in casing 107 of an earlier-described embodiment.

Figure 11:
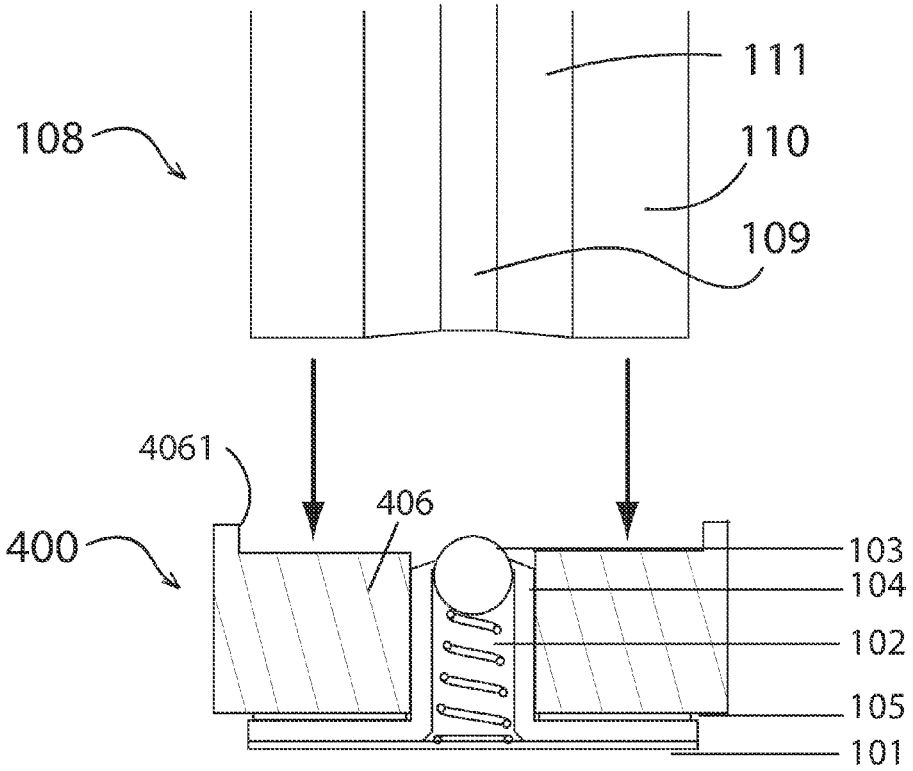
FIG. 11 is a cross section of a received side and a receiving side of an embodiment of the electrical connector.

FIG. 11 is a cross section of a received side 108 and a receiving side 400 of an embodiment of the electrical connector as disclosed. At the receiving side 400 of the present embodiment, the casing 107 is removed. That is, the annular magnetic member 406 is modified to have a heightened outer rim 4061, i.e., a retaining feature, to serve a function similar to that of the casing 107 alignment cavity 1071. Accordingly, the receiving side 400 of the present disclosure may be smaller in dimension than other embodiments and thus provide better portability. The remainder of the design of this embodiment is similar to that of receiving end 100 discussed above.

Figure 12:
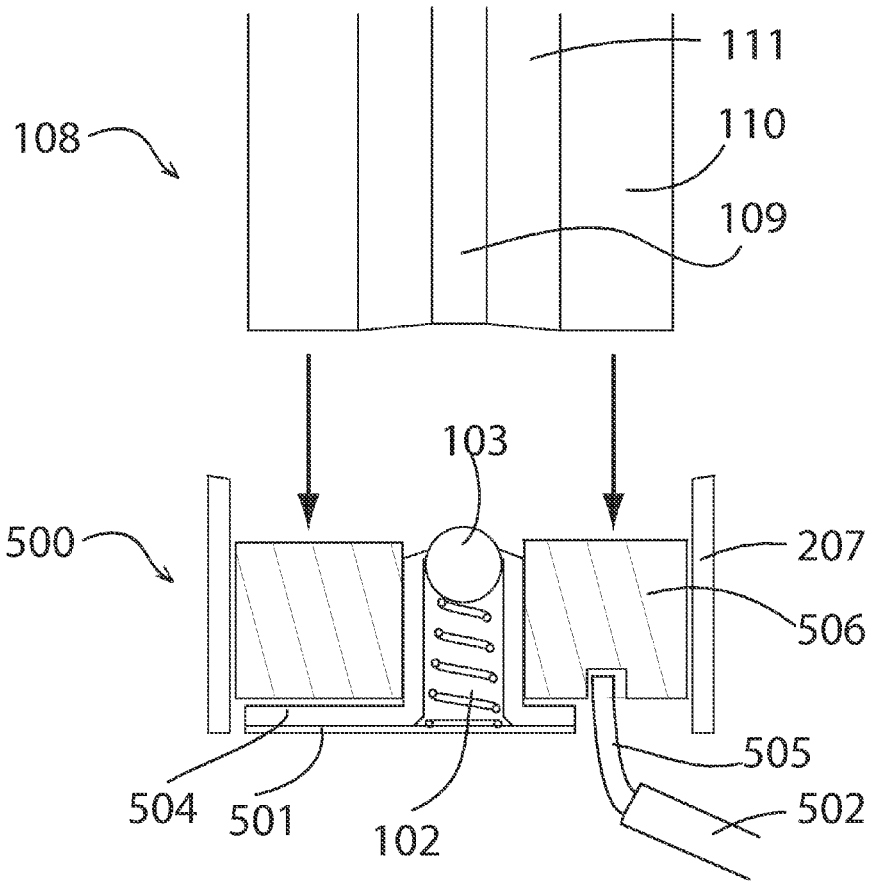
FIG. 12 is a cross section of a received side and a receiving side of an embodiment of the electrical connector.

FIG. 12 is a cross section of a received side 108 and a receiving side 500 of an embodiment of the electrical connector as disclosed. At the receiving side 500 of the present embodiment, the first terminal 105 is replaced by a cord 505 soldered, brazed, crimped, staked, or welded to the annular magnetic member 506. Second terminal 501 is modified so that the cord may be attached to the magnetic member 506, such as by forming a hole in, reducing the diameter of, or otherwise removing part of the second terminal 501. Likewise, columnar base 504 is modified to allow the cord to attach to the magnetic member 506. In this illustrative embodiment, the cord 505 is directly soldered to the annular magnetic member 506 so as to establish an electrical connection when the sleeve 110 abuts against the annular magnetic member 506. The cord 505 may then be surrounded by a non-conductive protective layer 502 to prevent the cord 505 from being damaged. The non-conductive protective layer 502 also prevents the cord 505 from contacting the second terminal 501 so as to avoid the electrical connection from being interrupted. Resilient member 102 and contact member 103 are as described in previous embodiments.

Figure 13:
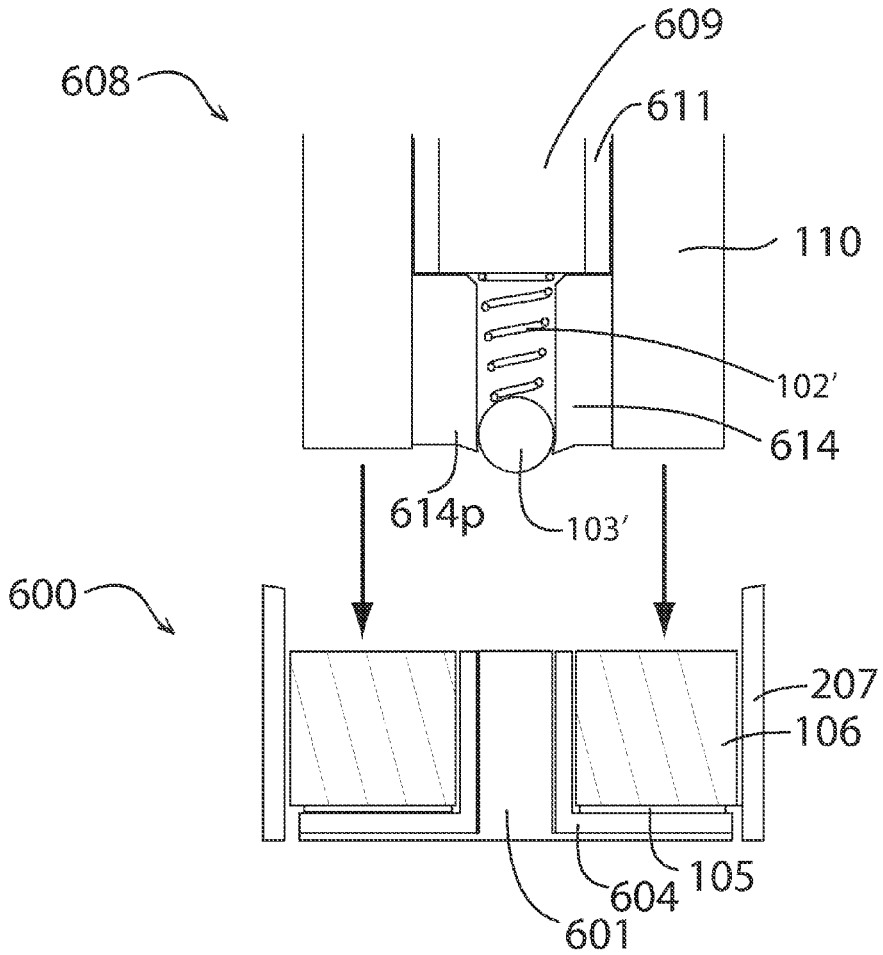
FIG. 13 is a cross section of a received side and a receiving side of an embodiment of the electrical connector.

FIG. 13 is a cross section of a received side 608 and a receiving side 600 of an embodiment of the electrical connector as disclosed. In this embodiment, some elements of a previously discussed embodiment of a received side 108 (discussed above in FIGS. 1-3 and FIG. 6) and a receiving side 101 (discussed above in FIGS. 4-6) are exchanged. For example, as illustrated in FIG. 12, the received side 608 comprises a coupling pin 609, a resilient member 102', a contact member 103', a retaining column 614 (with internal features similar to column 104*c* of columnar base 104, such as a retaining constriction near the proximal end 614*p*), and an insulation layer 611 contained within the sleeve 110. Whereas the receiving side 600 comprises the first terminal 105, the annular magnetic member 106, the casing 207 and a second terminal pin 601. The second terminal pin 601 is electrically insulated from the first terminal 105 by a columnar base 604. As shown, when the received side 608 is moved in the direction indicated by the arrows and thereby received in the receiving side 600, the contact member 103' contacts the second terminal pin 601, thereby exerts sufficient force to compress the resilient member 102', establishing effective electrical coupling between the second terminal pin 601 and the coupling pin 609. Simultaneously, the end of the sleeve 110 abuts and makes contact with the face of the annular magnetic member 106, establishing effective electrical connection therethrough to the first terminal 105. At such time, the entire received end 608 is urged into alignment by casing 207 and is snugly and securely retained in effective contact with the receiving side 600 via magnetic force from magnetic member 106. Retention of the components within casing 207 may be by magnetic attraction, adhesives, friction, or other conventional means; casing 207 may also have retaining walls as in casing 107 of a previous embodiment.

Figure 14:
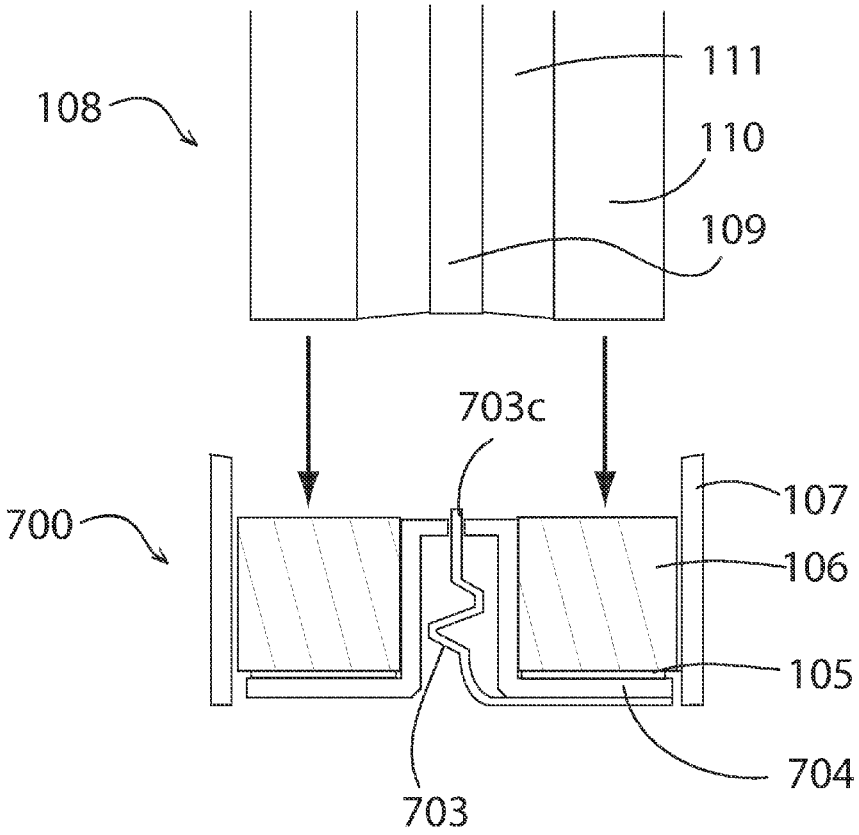
FIG. 14 is a cross section of a received side and a receiving side of an embodiment of the electrical connector.

FIG. 14 is a cross section of a received side 108 and a receiving side 700 of an embodiment of the electrical connector as disclosed. At the receiving side 700 of the present embodiment, the second terminal 101, the resilient member 102 and the contact member 103 are removed, and a sheet metal spring 703 having a contact tip 703*c* is deployed to implement the function of the combination of the second terminal 101, the resilient member 102 and the contact member 103. As illustrated, the sheet metal spring 703 is configured to be insulated from the first terminal 105 by the columnar base 704. In addition, a contact tip 703*c* of the sheet metal spring 703 protrudes from the opening of the columnar base 704. The contact tip 703*c* of the sheet metal spring 703 contacts the contact pin 109 when the received side 108 is retained within the receiving side 700, and an electrical connection is established between the contact pin 109 and the sheet metal spring 703. Likewise, the sleeve 110 contacts the annular magnetic member 106, establishing an electrical coupling as described previously.

Figure 15:
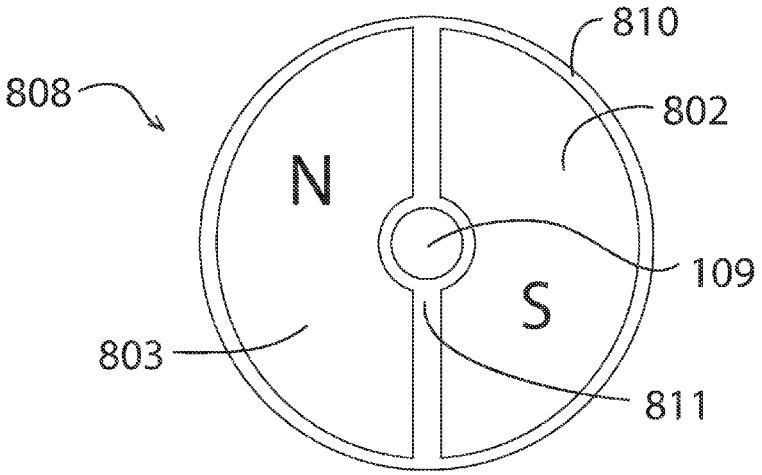
FIG. 15 is an end view of a received side of an embodiment of the electrical connector.

FIG. 15 is an end view of a received side 808 of an embodiment of the electrical connector as disclosed, showing a contact pin 109, a first magnetic member 802 and a second magnetic member 803. The contact pin 109 is substantially surrounded by the first magnetic member 802 and the second magnetic member 803. The contact pin 109, the first magnetic member 802 and the second magnetic member 803 are insulated from one another by an insulation layer 811, which may be any electrically nonconductive material, such as a polymer or air gap. A sleeve 810 surrounds the assembly, and because the sleeve in this embodiment is not required to be conductive, may be of an electrically insulative material, and may optionally be integral with the insulation layer 811.

Figure 16:
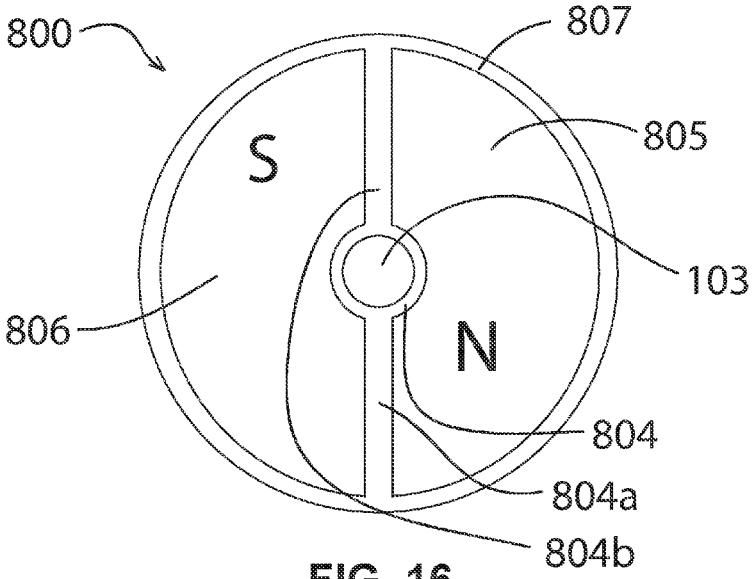
FIG. 16 is an end view of a receiving side of an embodiment of the electrical connector.

FIG. 16 is an end view of a receiving side 800 of an embodiment of the electrical connector as disclosed, showing a contact member 103, a third magnetic member 805 and a fourth magnetic member 806. The contact member 103 is substantially surrounded by the third magnetic member 805 and the fourth magnetic member 806, which may for example without limitation be semiannular magnets, bar magnets, or disk magnets. The third magnetic member 805 and fourth magnetic member 806 are preferably arranged to have opposite magnetic poles exposed at a proximal surface of the receiving side 800 so that they cause a received side 808 with similar properties to self-orient when brought into proximity. The contact member 103, the third magnetic member 805 and the fourth magnetic member 806 are electrically insulated from one another by a columnar base 804 similar to columnar base 104, made of electrically insulative material and modified to have separators 804*a*,804*b* between the third magnetic member 805 and fourth magnetic member 806. A casing 807 surrounds and constrains the assembly.

Figure 17:
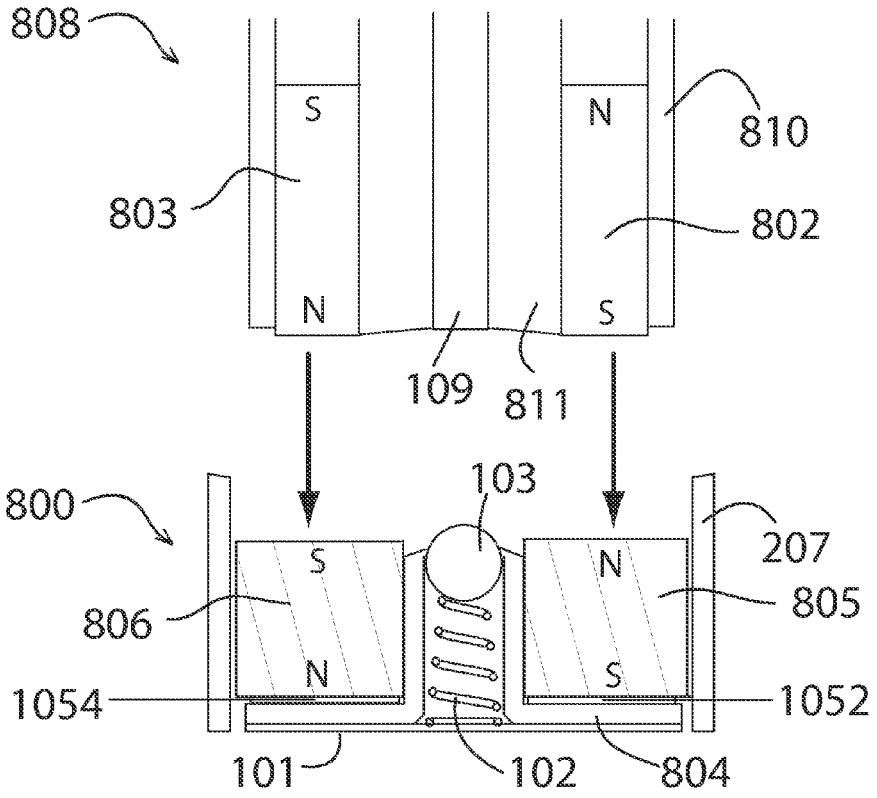
FIG. 17 is a cross section of a received side and a receiving side of an embodiment of the electrical connector.

FIG. 17 is a cross section of a received side 808 and a receiving side 800 of an embodiment of the electrical connector as disclosed. The upper part of FIG. 17 shows a contact pin 109 centered within the received side 808, being substantially surrounded by the first magnetic member 802 and the second magnetic member 803. The lower part of FIG. 17 shows the second terminal 101, the resilient member 102 seated thereon, the contact member 103 seated at the end of the resilient member 102, a columnar base 804, a first terminal 1052 and a third terminal 1054, a casing 207, and the third magnetic member 805 and the fourth magnetic member 806. The third magnetic member 805 is mounted on the first terminal 1052 and the fourth magnetic member 806 is mounted on the third terminal 1054. As illustrated, the present embodiment is configured such that when the received side 808 is moved in the direction indicated by the arrows and thereby received in the receiving side 800, the south pole of the first magnetic member 802 faces the north pole of the third magnetic member 805, and the north pole of the second magnetic 803 member faces the south pole of the fourth magnetic member 806. Accordingly, when the entire received end 808 is securely retained within the receiving side 800, three electrical connections are established between the contact pin 109 and the second terminal 101 (via the contact member 103 and the resilient member 102,) and between the first magnetic member 802 and the first terminal 1052 (via the third magnetic member 805,) and between the second magnetic member 803 and the third terminal 1054 (via the fourth magnetic member 806.) The additional electrical connection may allow the present disclosure to transmit electrical signals, for purposes other than electricity transmission.

It is to be noted that in this embodiment, rotation or radial twist of the received side 808 within the receiving side 800 may result in disconnection of the received side 808 and the receiving side 800 due to the repulsive force between the first magnetic member 802 and the fourth magnetic member 806, and between the second magnetic member 804 and the third magnetic member 805. Consequently, rotation or radial twist of the received side 808 within the receiving side 800 may be used as a measure to separate the received side 808 and the receiving side 800.

Figure 18:
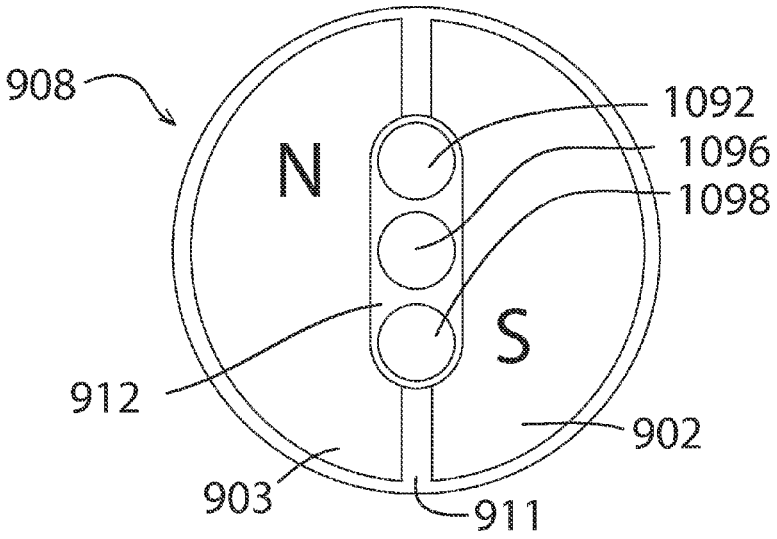
FIG. 18 is an end view of a received side of an embodiment of the electrical connector.

FIG. 18 is an end view of a received side 908 of an embodiment of the electrical connector as disclosed, showing contact pins 1092, 1096 and 1098, a first magnetic member 902 and a second magnetic member 903. The contact pins 1092, 1096 and 1098 are substantially surrounded by the first magnetic member 902 and the second magnetic member 903. The contact pins 1092, 1096 and 1098, the first magnetic member 902 and the second magnetic member 903 are electrically insulated from one another by insulating layers 911 and 912. Insulating layers 911 and 912 may be separate components or unitary. First magnetic member 902 and second magnetic member 903 may, for example without limitation, be semiannular, like 802 and 803 of FIG. 15, or may be a more closely fitted custom shape as shown, or may be bar magnets, or disk magnets.

Figure 19:
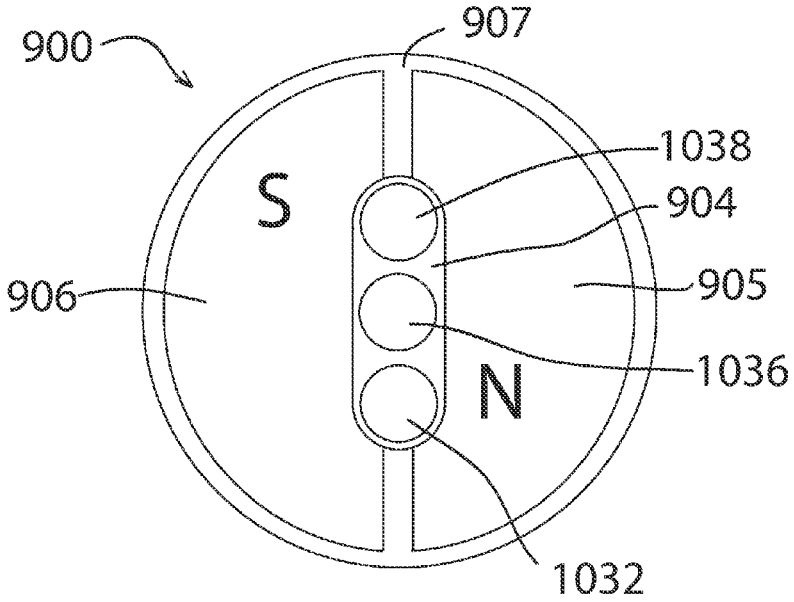
FIG. 19 is an end view of a receiving side of an embodiment of the electrical connector.

FIG. 19 is an end view of a receiving side 900 of an embodiment of the electrical connector as disclosed, showing contact members 1032, 1036 and 1038, and a third magnetic member 905 and a fourth magnetic member 906. The contact members 1032, 1036 and 1038 are constrained within the column of a columnar base 904 and are substantially surrounded by the third magnetic member 905 and the fourth magnetic member 906. The contact members 1032, 1036 and 1038, the third magnetic member 905 and the fourth magnetic member 906 are insulated from one another. Third magnetic member 905 and fourth magnetic member 906 may, for example without limitation, be semiannular, like magnetic members 805 and 806 of FIG. 16, or may be a more closely fitted custom shape as shown, or may be bar magnets, or disk magnets. A housing 907 surrounds and contains the components.

Figure 20:
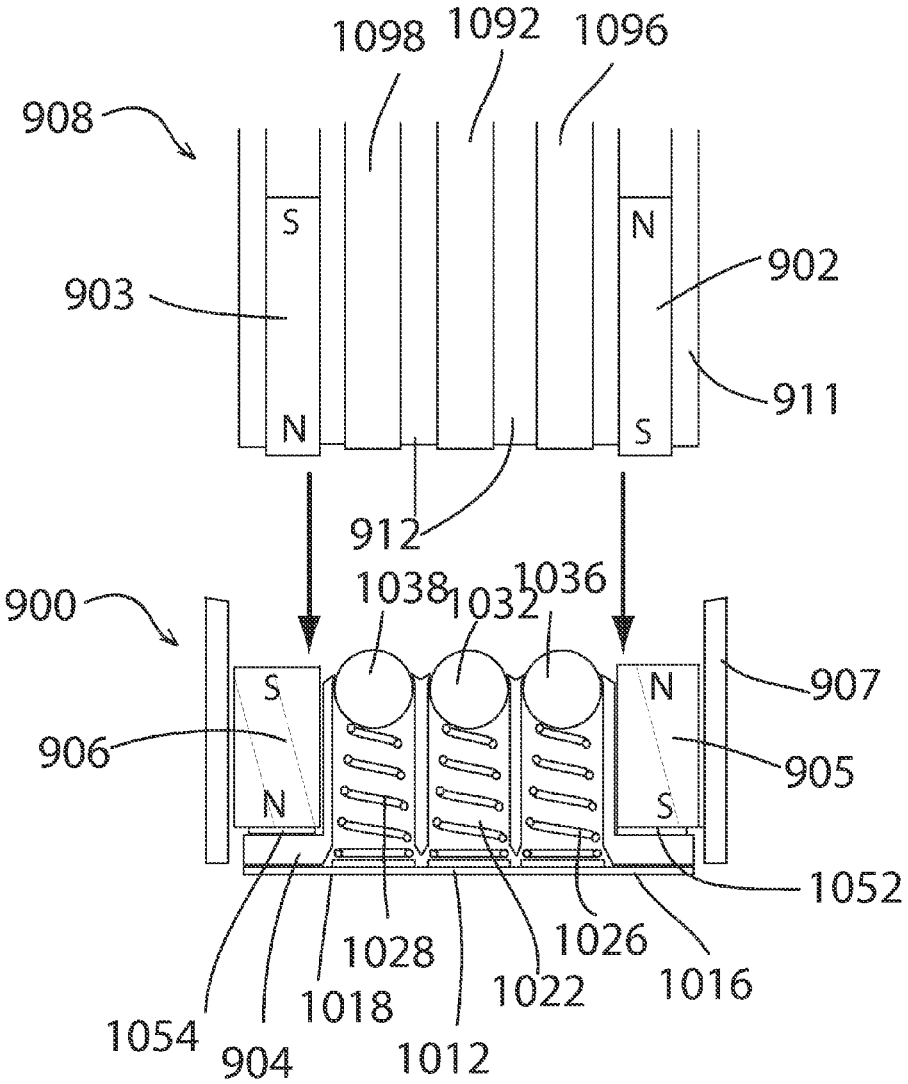
FIG. 20 is a cross section of a received side and a receiving side of an embodiment of the electrical connector.

FIG. 20 is a cross section of a received side 908 and a receiving side 900 of an embodiment of the electrical connector as disclosed. The upper part of FIG. 20 shows contact pins 1092, 1096 and 1098 within the received side 908, being surrounded by the first magnetic member 902 and the second magnetic member 903. The lower part of FIG. 20 shows three terminals 1012, 1016 and 1018, the corresponding resilient members 1022, 1026 and 1028 seated thereon respectively, the corresponding contact members 1032, 1036 and 1038 seated at the ends of the resilient members 1022, 1026 and 1028 respectively, a columnar base 904 with three openings for spring type terminals, two magnetic terminals 1052 and 1054, a casing 107, and the third magnetic member 905 and the fourth magnetic member 906. The third magnetic member 905 is mounted on the magnetic terminal 1052 and the fourth magnetic member 906 is mounted on the magnetic terminal 1054. As illustrated, the present embodiment is configured such that when the received side 908 is moved in the direction indicated by the arrows and thereby received in the receiving side 900, the south pole of the first magnetic member 902 faces the north pole of the third magnetic member 905, and the north pole of the second magnetic member 903 faces the south pole of the fourth magnetic member 906. Accordingly, when the entire received end 908 is securely retained within the receiving side 900, five electrical connections are established between the contact pin 1092 and spring terminal 1012 (via the contact member 1032 and the resilient member 1022), and between the contact pin 1096 and spring terminal 1016 (via the contact member 1036 and the resilient member 1026), and between the contact pin 1098 and spring terminal 1018 (via the contact member 1038 and the resilient member 1028), and between the first magnetic member 902 and magnetic terminal 1052 (via the third magnetic member 905), and between the second magnetic member 903 and magnetic terminal 1054 (via the fourth magnetic member 906). The three 27 additional electrical connections, five total, may allow the present disclosure to transmit multiple electrical signals, for signal transmission, power supply, or other purposes. Such electrical signals may implement data transmission or any other use of electrical signals known to persons having ordinary skill in the art. The electrical connections may, for example, be used to transmit USB data without modification to the USB protocol.

It is to be noted that in this embodiment, rotation or radial twist of the received side 908 within the receiving side 900 may result in disconnection of the received side 908 and the receiving side 900 due to the repulsive force between the first magnetic member 902 and the fourth magnetic member 906, and between the second magnetic member 903 and the third magnetic member 905. Consequently, rotation or radial twist of the received side 908 within the receiving side 900 may be used as a measure to separate the received side 908 and the receiving side 900. It is to be further noted that the number of electrical connections may be increased by modifying the structures of the receiving side 900 and the received side 908 according to this embodiment, in ways obvious to persons having ordinary skill in the art, for example resulting in nine connectors for a packed hexagonal configuration (seven for the hexagonal array plus two for the magnets) or eleven for a 3×3 square array (nine for the square array plus two through the magnets).

Figure 21A:
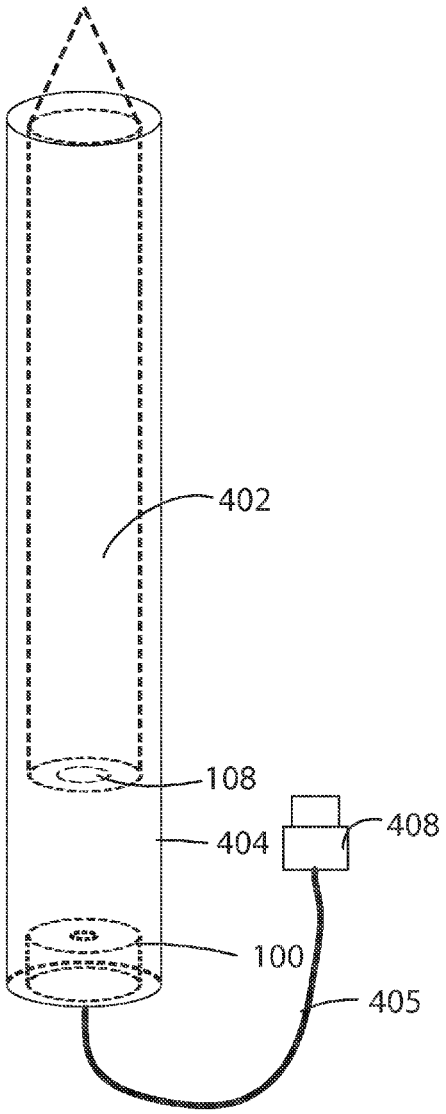
FIGS. 21A and 21B are perspective views of the received side and the receiving side of an embodiment of the electrical connector as may be implemented with a stylus.
Figure 21B:
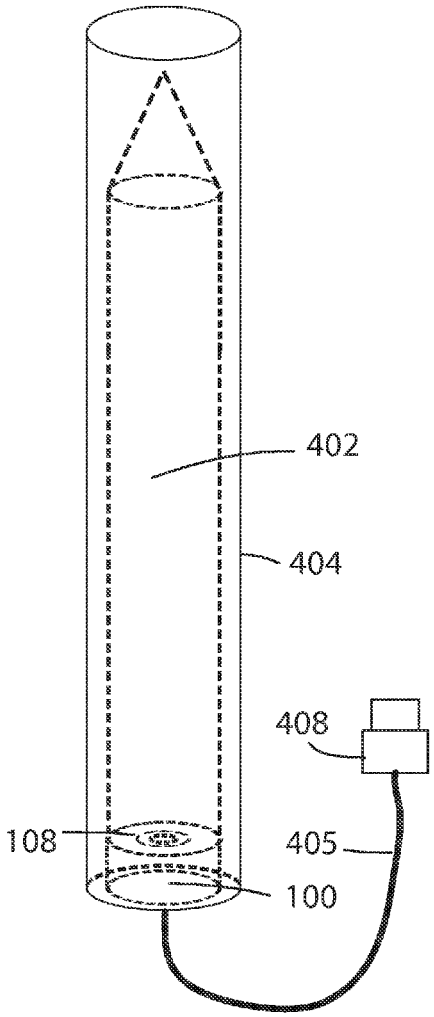

FIGS. 21A and 21B are perspective views of the received side 108 and the receiving side 100 of the electrical connector as disclosed, being applied to an electronic device according to some embodiments. For example, the electronic device may be a stylus 402 and the received side 108 may be deployed at an end of the stylus 402. A protector 404 is designed to receive the stylus 402 to provide protection when the stylus is inside the protector 404. The receiving side 100 is deployed within the protector 404 such that when the stylus 402 is received by the protector 404, the received side 108 of the stylus 402 and the receiving side 100 of the protector 404 mate and securely contact with each other. The protector 404 may have a cord 405 connected to the received side 100. The cord 405 may be further connected with a connection port 408 to be electrically communicative with a power source or signal source. In this example, the connection port 408 may be an USB port, but the present disclosure is not so limited.

FIG. 22 is an illustrative view of the received side 108 and the receiving side 100 of the electrical connector as disclosed, being applied to an electronic device according to some embodiments. The electronic device may be any touch screen equipped device. In this example, the touch screen-equipped device is a tablet PC 2000. As illustrated in FIG. 22, a peripheral of the tablet PC 2000 is provided. Here, the stylus protector 2007 is combined with the peripheral of the tablet PC 2000 for receiving the stylus 402. When the stylus 402 is received by the protector 2007, the received side 108 of the stylus 402 and the receiving side 100 of the protector 2007 mate and securely contact with each other. The received side 100 is electrically communicative with the tablet PC 2000, and the tablet PC 2000 may provide power to the stylus 402 or may communicate data with the stylus 402. Any of the embodiments of the received side and receiving side may be used, providing additional electrical connections for power and/or data, and/or for providing a polarized connective coupling.

Figure 23:
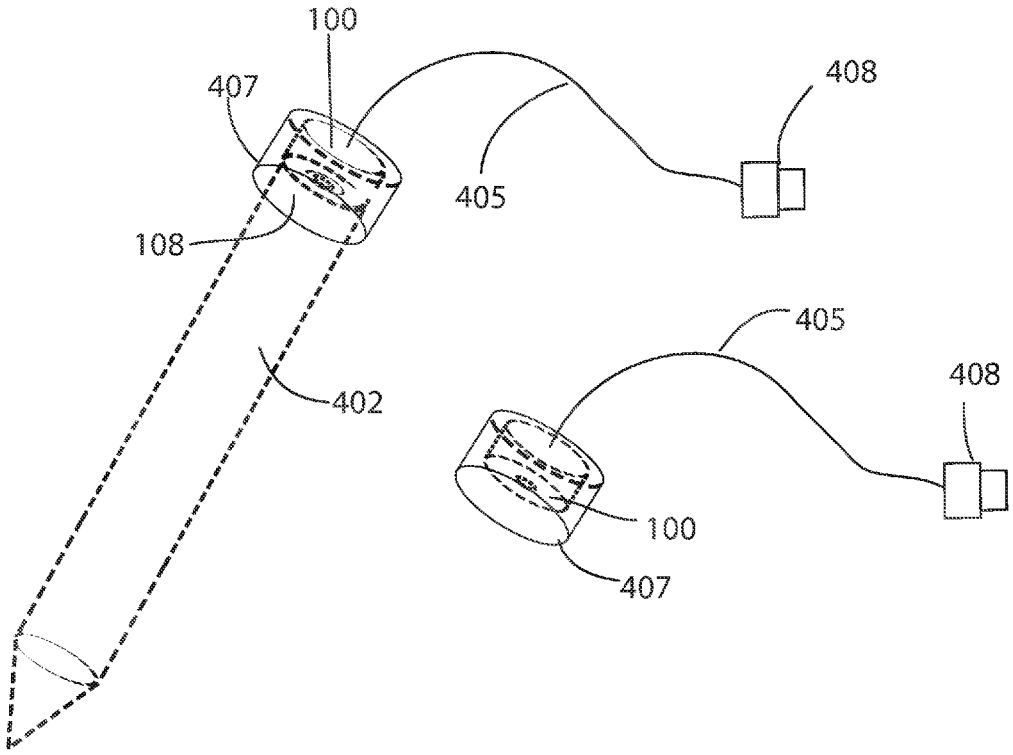
FIG. 23 is an illustrative view of the received side and the receiving side of the electrical connector being applied to an electronic peripheral.

FIG. 23 is an illustrative view of the received side 108 and the receiving side 100 of the electrical connector as disclosed, being applied to an electronic peripheral according to some embodiments. For example, the protector 407 is sized merely to accommodate the received side 100. Thus, when the receiving side 108 contacts with the received side 100, a substantial portion of the stylus 402 protrudes out of the protector 407. The protector 407 may have a cord 405 connected to the received side 100. The cord 405 is further connected with a connection port 408 to be electrically communicative with a power source or signal source. In this example, the connection port 408 may be an USB port, but the present disclosure is not so limited. In this embodiment, the combination of the protector 404, the cord 405 and the connection port 408 serve as a handy transmission line or power charger for the stylus 402.

Figure 24A:
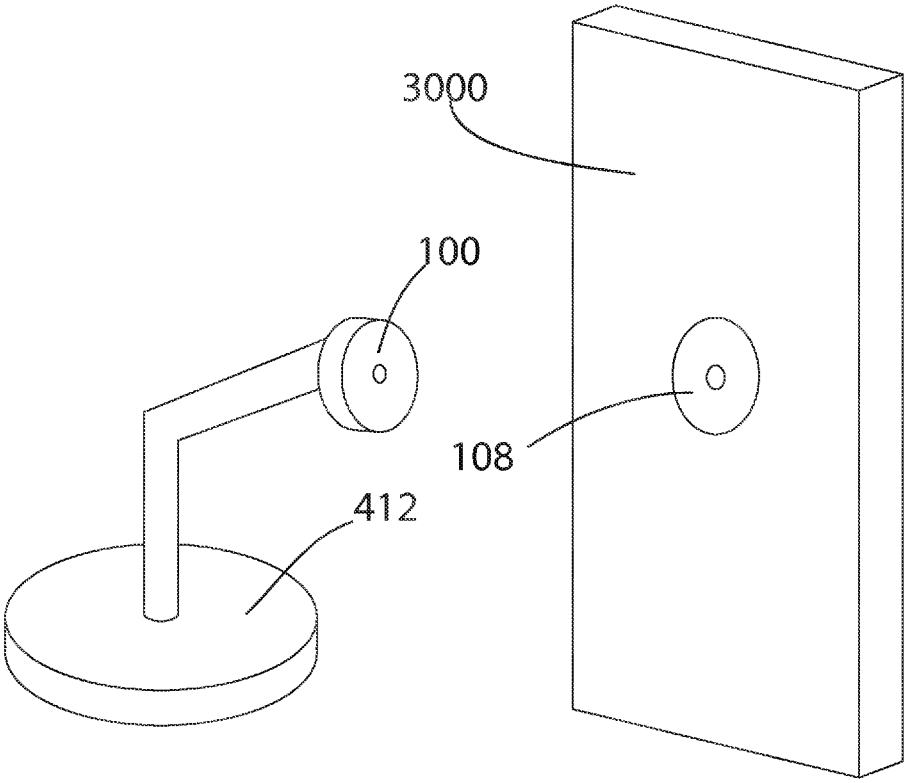
FIGS. 24A and 24B are illustrative views of the received side and the receiving side of the electrical connector as disclosed, being applied to an electronic device.
Figure 24B:
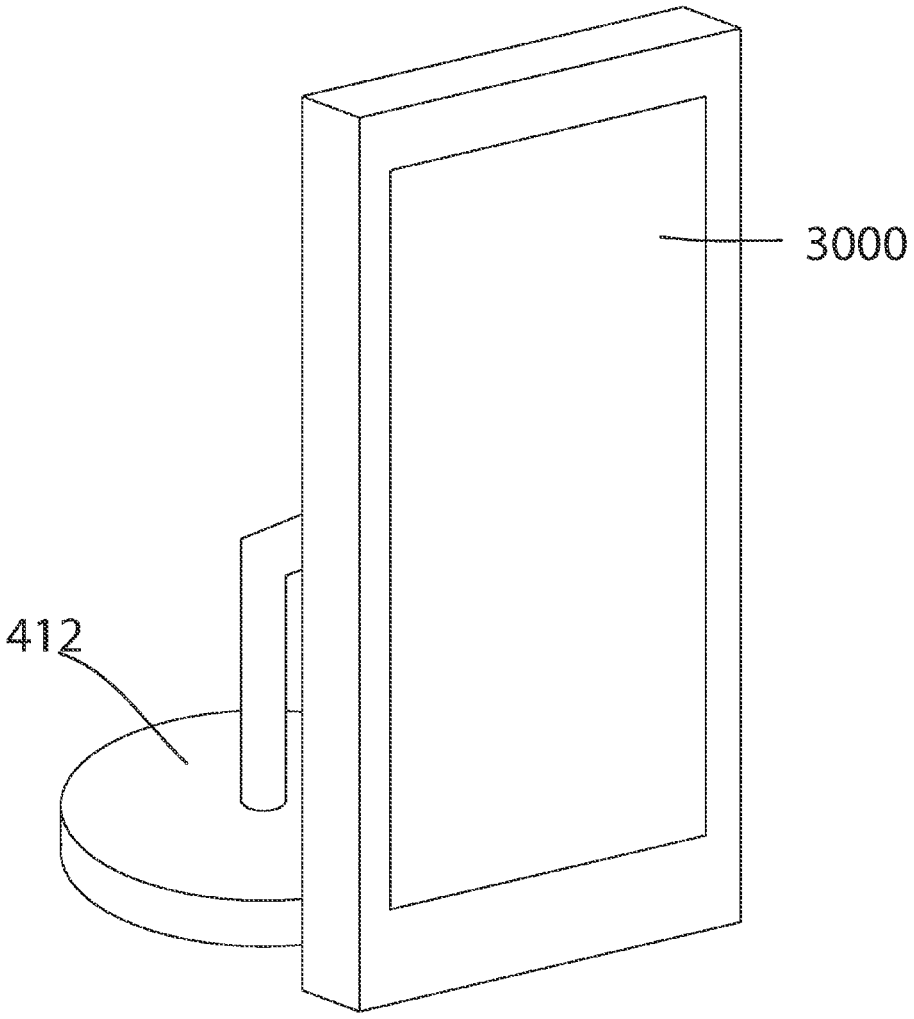

FIGS. 24A and 24B are illustrative views of the received side 108 and the receiving side 100 of the electrical connector as disclosed, being applied to an electronic device according to some embodiments. For example, the receiving side 108 is deployed on one surface of an electronic device 3000. The electronic device 3000 may be a tablet PC, cellphone, GPS unit, or any other touch screen-equipped device. On the other hand, the receiving side 100 is combined with a base 412, as illustrated in FIG. 24A. By connecting the receiving side 100 and the received side 108, the electronic device 3000 is magnetically connected to the base 412 so that the electronic device 3000 is held in a preferred orientation, as illustrated in FIG. 24B. Use of a magnetically polarized embodiment such as shown in FIGS. 15-17 or FIGS. 18-20 will hold the electronic device in a preferred orientation; use of a nonpolarized rotatable embodiment such as the various embodiments shown in FIGS. 1-14 will allow the electronic device to be user positioned at any angle of rotation, and will hold the device at the chosen angle through friction forces within design limits that may be determined through testing. A friction-enhancing coating such as rubber may be applied to nonconducting portions of contact surfaces to enhance holding ability.

Figure 25:
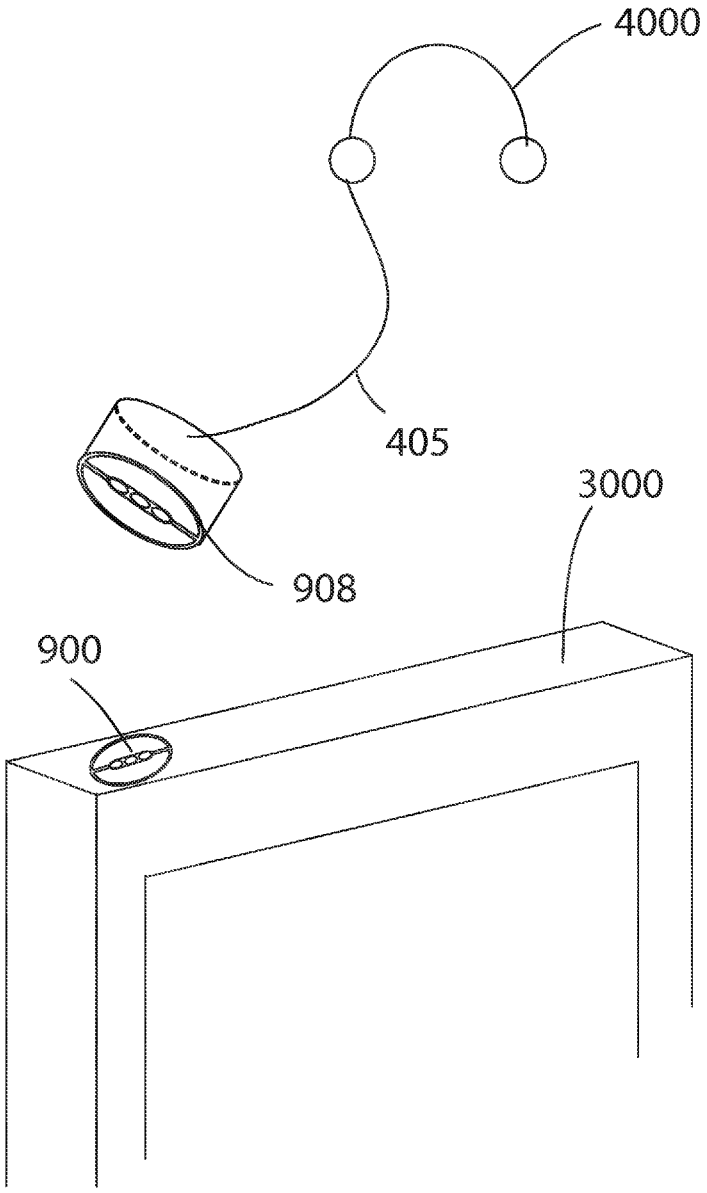
FIG. 25 is an illustrative view of the received side and the receiving side of the electrical connector as disclosed, being applied to an electronic device.

FIG. 25 is an illustrative view of the received side 908 and the receiving side 900 of the electrical connector as disclosed, being applied to an electronic device according to some embodiments. In this example, the received side 908 is connected to a cord 405 of a headphone 4000, and the receiving side 900 is combined with an electronic device 3000, such as a tablet PC, MP3 player, or cellphone. Specifically, five connections are established between the receiving side 900 and the received side 908, as illustrated in FIG. 20. The five connections embodiment enables the electronic device to provide power and data simultaneously to peripherals that needs multiple connections, such as the headphone 4000, but the present disclosure is not so limited.

Figure 26:
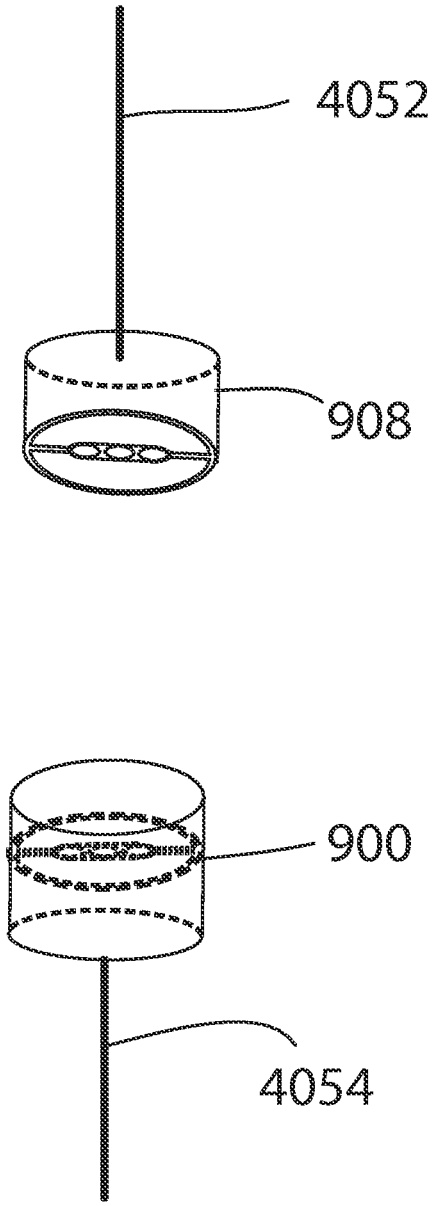
FIG. 26 is an illustrative view of the received side and the receiving side of the electrical connector as disclosed, being used as an electronic peripheral.

FIG. 26 is an illustrative view of the received side 908 and the receiving side 900 of the electrical connector as disclosed, being used as an electronic peripheral according to some embodiments. In this example, the receiving side 900 is directly connected to a cord 4054, and the received side 908 is directly connected to a cord 4052. This embodiment demonstrates that the receiving side 900 and/or the received side 908 need not be embedded in electronic devices.

The electrical connector as disclosed provides a secure and effective electrical connection with separation thereof accommodated with no resultant damage thereto when sufficient force is applied to overcome the provided magnetic attraction between the constituent sides. Further, effective connection is achieved when the constituent sides are in any lateral alignment, irrespective of their relative radial orientation. Finally, rotation of the received side within the receiving side is accommodated with no undue strain or damage inflicted on cabling attached thereto in some embodiments.

While the disclosure has been described by way of example and in terms of preferred embodiment, it is to be understood that the disclosure is not limited thereto. To the contrary, it is intended to cover various modifications and similar arrangements (as would be apparent to those skilled in the art).

What is claimed is:

1. A magnetic coupler assembly comprising a first mating element and a second mating element, the first mating element comprising:

a housing having an alignment cavity, a plug assembly fixedly mounted to the housing, the plug assembly comprising a plurality of conductive contacts, a first magnet comprising a magnetic mating surface, a first electrical contact electrically coupled to the first magnet;

a contact member disposed within the first magnet and electrically insulated from the first magnet, a second electrical contact electrically coupled to the contact member; and the first electrical contact coupled to a first conductive contact of the plurality of conductive contacts, the second electrical contact coupled to a second conductive contact of the plurality of conductive contacts; and the second mating element comprising: an outer surface, a ferromagnetic conducting element having a mating surface, and a second conducting element insulated from the ferromagnetic conducting element; the outer surface fitting within the alignment cavity of the first mating element such that the mating surface of the ferromagnetic conducting element mates with the magnetic mating surface and the second conducting element electrically couples to the contact member.

2. The magnetic coupler assembly of claim 1 where the contact member is a sheet metal spring.

3. The magnetic coupler assembly of claim 1 where the contact member is a ball bearing, and the ball bearing is biased above the magnetic mating surface by a spring, said spring electrically coupling the ball bearing to the second conductive contact of the plug assembly.

4. The magnetic coupler assembly of claim 3 where the spring is a sheet metal spring integrally formed in the second electrical contact.

5. The magnetic coupler assembly of claim 3 where the spring is a coil spring.

6. The magnetic coupler assembly of claim 1 wherein: the first mating element further comprises a second magnet disposed such that a magnetic polarity of the second magnet is opposite a magnetic polarity of the first magnet, the magnetic polarity of the first magnet being normal to the magnetic mating surface of the first magnet; and the ferromagnetic conducting element of the second mating element is a third magnet, and the second mating element further comprises a fourth magnet, the third magnet and fourth magnet being fixedly mounted in the second mating element, the third magnet and fourth magnet being oriented to expose opposite magnetic polarities, the magnetic polarity of the third magnet being oriented normal to the mating surface.

7. A magnetic connector comprising:

a first mating element fixedly mounted in a housing, at least one contact member, a plug fixedly mounted in the housing;

the plug having a plurality of leads, the first mating element electrically coupled to a first lead of the plurality of leads; and the contact member electrically coupled to a second lead of the plurality of leads, the first mating element being an annular permanent magnet having a center hole, the contact member being a ball bearing disposed within an electrically insulating column, the electrically insulated column disposed within the center hole of the annular permanent magnet.

8. The magnetic connector of claim 7 wherein the second mating element is a ball bearing, the electrically insulated column constricts at an end through which the second mating element protrudes, the second mating element is biased outwardly by a coil spring, and the coil spring electrically couples the second mating element to the second lead.

9. The magnetic connector of claim 7 further comprising a plurality of contact members, each contact member disposed within an electrically insulated column of a plurality of electrically insulated columns, each contact member electrically coupled to a lead of the plurality of leads.

10. The magnetic connector of claim 9 wherein each contact member of the plurality of contact members is a ball bearing, the each electrically insulated column of the plurality of electrically insulated columns constricts at an end through which its respective contact member protrudes, the each contact member of the plurality of contact members is biased outwardly by a coil spring of a plurality of coil springs, and each coil spring of the plurality of coil springs electrically couples the each contact member of the plurality of contact members to the lead of the plurality of leads.

11. The magnetic connector of claim 10 where each contact member of the plurality of contact members is in electrical contact with a different lead of the plurality of leads.

12. The magnetic connector of claim 7 further comprising a base, the base being mountable to a surface to provide a stable releasable attachment for an electronic device.

* * * * *